US012716313B2

(12) United States Patent
Lock

(10) Patent No.: US 12,716,313 B2
(45) Date of Patent: Aug. 25, 2026

(54) ROTATING CONTROL DEVICE CLAMPING MECHANISM

(71) Applicant: BEYOND ENERGY SERVICES & TECHNOLOGY CORP., Calgary (CA)

(72) Inventor: Jason Lock, Grand Prairie (CA)

(73) Assignee: BEYOND ENERGY SERVICES & TECHNOLOGY CORP., Calgary (CA)

( * ) Notice: Subject to any disclaimer, the term of this patent is extended or adjusted under 35 U.S.C. 154(b) by 0 days.

(21) Appl. No.: 18/517,974

(22) Filed: Nov. 22, 2023

(65) Prior Publication Data

US 2024/0093566 A1 Mar. 21, 2024

Related U.S. Application Data

(63) Continuation of application No. 16/493,554, filed as application No. PCT/CA2018/000018 on Feb. 1, 2018, now abandoned.

(30) Foreign Application Priority Data

Feb. 3, 2017 (CA) ..... CA 2956937

(51) Int. Cl.
*E21B 33/08* (2006.01)
*E21B 21/08* (2006.01)

(52) U.S. Cl.
CPC ..... *E21B 33/085* (2013.01); *E21B 21/08* (2013.01)

(58) Field of Classification Search
CPC ..... E21B 33/085; E21B 21/08; E21B 19/004; E21B 19/006; E21B 33/0085
(Continued)

(56) References Cited

U.S. PATENT DOCUMENTS 3,096,999 A * 7/1963 Ahlstone ..... E21B 7/20 175/57
3,568,715 A * 3/1971 Taylor, Jr. ..... E21B 34/045 166/321

(Continued)

OTHER PUBLICATIONS

International Search Report dated Apr. 16, 2018 in PCT/CA2018/000018, filed on Feb. 1, 2018, 4 pages.

(Continued)

*Primary Examiner* — Edwin J Toledo-Duran
(74) *Attorney, Agent, or Firm* — Duane Morris LLP

(57) ABSTRACT

A closure arrangement for use on a rotating control device used during managed pressure drilling, said closure arrangement adapted for the installation of a bearing assembly adapted for insertion into a body, said body defining an upper circular opening and comprising an outer circumferential edge, said closure arrangement comprising:

a closure collet comprising:

a top section comprising an outwardly protruding shoulder and an inwardly protruding shoulder; and a plurality of spaced apart fingers extending downwardly therefrom forming a middle section and a bottom section of said collet; said fingers adapted to securely and removably fit around said outer circumferential edge of said body; and a collet lock ring adapted to slidingly move between a first position defined by the middle section of the closure collet and a second position proximate the bottom section of the closure collet; wherein, when the closure arrangement is in use, the bearing assembly is securely inserted into said body and the collet lock ring is secured around the bottom section of the closure collet.

7 Claims, 6 Drawing Sheets

(58) Field of Classification Search
USPC ..... 166/345, 358, 360, 367; 405/224.2, 405/224.4; 414/137.5, 803
See application file for complete search history.

(56) References Cited

U.S. PATENT DOCUMENTS 3,568,770 A * 3/1971 Fredd ..... E21B 23/08 166/217
3,628,812 A * 12/1971 Larralde ..... F16L 37/133 285/364
3,628,822 A * 12/1971 Bostock ..... E21B 31/18 294/86.18
3,741,601 A * 6/1973 Dudley ..... E21B 31/18 294/86.18
4,093,281 A * 6/1978 Jansen, Jr. ..... F16L 15/003 285/39
4,477,105 A * 10/1984 Wittman ..... F16L 37/52 285/261
4,491,346 A * 1/1985 Walker ..... E21B 17/0853 285/321
4,557,508 A * 12/1985 Walker ..... F16L 37/138 285/321
4,693,497 A * 9/1987 Pettus ..... F16L 37/002 285/12
4,708,524 A * 11/1987 Goris ..... E21B 41/10 403/322.3
4,817,992 A * 4/1989 Yip ..... F16L 37/12 285/920
4,823,879 A * 4/1989 Brammer ..... E21B 33/038 166/359
4,902,045 A * 2/1990 McGugan ..... F16L 1/26 285/82
5,069,288 A * 12/1991 Singeetham ..... E21B 33/043 166/348
5,197,546 A * 3/1993 Murray ..... E21B 23/02 166/382
5,553,667 A * 9/1996 Budde ..... E21B 33/165 166/73
5,761,785 A * 6/1998 Connolly ..... B23P 19/045 29/244
6,062,312 A * 5/2000 Wilkins ..... E21B 23/04 166/360
6,142,233 A * 11/2000 Wilkins ..... E21B 33/038 166/360
6,231,265 B1 * 5/2001 Rytlewski ..... E21B 17/02 166/341
6,557,637 B1 * 5/2003 Dore ..... E21B 34/04 166/359
6,609,734 B1 * 8/2003 Baugh ..... F16L 37/002 285/123.4
6,612,010 B2 * 9/2003 Bekkevold ..... F16L 37/62 29/237
6,824,171 B2 * 11/2004 Milberger ..... F16L 37/138 285/369
7,686,087 B2 * 3/2010 Pallini ..... E21B 33/038 166/359
7,686,342 B2 * 3/2010 Jennings ..... F16L 19/0231 285/912
8,479,824 B2 * 7/2013 Travis ..... E21B 33/0422 166/344
8,678,108 B1 * 3/2014 Eriksen ..... E21B 7/20 175/57
8,757,671 B2 * 6/2014 Pallini, Jr. ..... E21B 17/043 285/35
8,978,770 B2 * 3/2015 DeBerry ..... E21B 17/0853 166/344
9,255,453 B1 * 2/2016 Jennings ..... E21B 17/0853
9,617,819 B2 * 4/2017 Older ..... F16L 1/26
9,657,536 B2 * 5/2017 Weir ..... F16L 23/036
9,810,206 B2 * 11/2017 Considine, Jr. ..... F16L 37/138
9,982,502 B2 * 5/2018 Nelson ..... E21B 33/04
10,260,290 B2 * 4/2019 Pollack ..... E21B 17/015
10,337,845 B2 * 7/2019 Jansson ..... F42B 12/625
11,566,738 B2 * 1/2023 Bhat ..... F16L 37/138
11,649,689 B1 * 5/2023 Cheng ..... F16J 15/189 166/387
2002/0121379 A1 * 9/2002 Doane ..... E21B 23/01 166/134
2002/0121380 A1 * 9/2002 Doane ..... E21B 23/01 166/134
2003/0094284 A1 * 5/2003 Fenton ..... E21B 33/038 166/347
2003/0141718 A1 * 7/2003 Bilderbeek ..... E21B 17/0853 285/348
2004/0040709 A1 * 3/2004 Rogers ..... E21B 17/06 166/290
2005/0001427 A1 * 1/2005 Liew ..... E21B 33/038 285/322
2005/0051337 A1 * 3/2005 Jennings ..... E21B 33/043 166/368
2005/0145391 A1 * 7/2005 Lequang ..... E21B 33/03 166/242.6
2005/0236158 A1 * 10/2005 Miyahara ..... E21B 33/085 166/85.4
2009/0273201 A1 * 11/2009 Slack ..... E21B 19/07 294/86.25
2011/0042107 A1 2/2011 Chambers et al.
2011/0227336 A1 * 9/2011 Mogedal ..... E21B 17/085 285/314
2012/0305262 A1 * 12/2012 Ballard ..... E21B 17/01 166/363
2012/0328373 A1 * 12/2012 Bond ..... E21B 43/0122 405/210
2013/0186643 A1 * 7/2013 Angelle ..... B66C 1/12 166/380
2013/0287499 A1 * 10/2013 Fraczek ..... E21B 19/06 405/173
2014/0178155 A1 6/2014 Feasey
2014/0202768 A1 7/2014 Noske
2016/0168947 A1 * 6/2016 Hayter ..... E21B 33/134 166/135
2019/0024470 A1 * 1/2019 Cummins ..... E21B 23/04

OTHER PUBLICATIONS

International Preliminary Report on Patentability dated Aug. 6, 2019 in PCT/CA2018/000018, filed Feb. 1, 2018, 6 pages.

* cited by examiner

ROTATING CONTROL DEVICE CLAMPING MECHANISM

CROSS REFERENCE TO RELATED APPLICATION

This application is a continuation application of U.S. patent application Ser. No. 16/493,554 filed on Sep. 12, 2019, which is a national stage application under 35 U.S.C. 371 of PCT Application No. PCT/CA2018/000018 having an international filing date of Feb. 1, 2018, which designated the United States, which PCT application claimed the benefit of Canadian Application Serial No. 2,956,937, filed Feb. 3, 2017, each of which are incorporated by reference in their entirety.

FIELD OF THE INVENTION

This invention relates to a rotating control device, more specifically to a new rotating control device assembly clamping mechanism.

BACKGROUND OF THE INVENTION

In the oil and gas industry, managed pressure drilling (MPD) is important in order to help in minimizing drilling hazards with pressure control. MPD involves actively controlling well pressure. By using a closed-loop system the operators using MPD can determine a well's downhole pressure limits and can also manage the annular pressure profile.

Rotating control devices (RCDs) create a pressure-tight barrier in the wellbore annulus that enables safe fluid containment and diversion, a vital defense against drilling hazards. As a critical element of managed pressure drilling (MPD) systems, RCDs provide an additional line of defense to protect oil rig personnel and equipment.

RCD devices provide an annular pressure seal in various diameter wells under standard temperature conditions. RCD devices enable drilling operations in managed pressure drilling to continue while isolating rig personnel from potentially harmful wellbore fluids and gases.

The flowline hub and clamp is the connection for attaching pipe work to the RCD for fluid to flow through. Previously this was done with either hammer unions or flanges. Flanges increase the overall high and/or width with additional machining required on the unit. Hammer unions will increase overall width and can be damaged easily and cause leaks. Flanges are difficult to install in the tight areas or some rigs as installing the studs is much more precise then the connections of a hammer union and hub and clamp. The main reasons therefore of this are to decrease overall height and width in a fashion that does not decrease the durability of the unit. The main point of the connection is relevant to the overall height of the entire assembly of the body and bearing assembly as well the overall outer diameter—these are two key factors which need to be taken into account when considering new designs.

Despite the available technologies to use with RCDs, there still exists a need for a clamping mechanism which facilitates the operational use of the RCD and can preferably increase the safety profile in installing RCDs.

The inventors have designed and developed a novel clamping mechanism (also referred to as a closure arrangement) for rotating control devices (RCDs) along with a novel hub attachment which greatly facilitates operations involving RCDs.

SUMMARY OF THE INVENTION

According to a first aspect of the present invention, there is provided a novel rotating control device (RCD) for use managed pressure devices used in drilling oil (and gas) wells. One of the advantages of the present invention is that it provides a quicker system allowing for the various pieces of a clamping and closure assembly to be attached much faster.

According to an aspect of the present invention, there is provided a closure arrangement for use on a rotating control device used during managed pressure drilling, said closure arrangement adapted for the installation of a bearing assembly adapted for insertion into a body, said body defining an upper circular opening and comprising an outer circumferential edge, said closure arrangement comprising:

- a closure collet comprising:
  - a top section comprising an outwardly protruding shoulder and an inwardly protruding shoulder; and a plurality of spaced apart fingers extending downwardly therefrom forming a middle section and a bottom section of said collet; said fingers adapted to securely and removably fit around said outer circumferential edge of said body; and
- a collet lock ring adapted to slidingly move between a first position defined by the middle section of the closure collet and a second position proximate the bottom section of the closure collet; wherein, when the closure arrangement is in use, the bearing assembly is securely inserted into said body and the collet lock ring is secured around the bottom section of the closure collet.

Preferably, the inwardly protruding shoulder of the closure collet is adapted to fit a complementary cavity located on said bearing assembly.

Preferably also, the closure collet comprises a single piece comprising an upper section itself comprising a solid upper ring, and a lower section comprising a plurality of flexible fingers integral with the upper section adapted to allow the expansion of the lower part over the outer circumferential edge of the body when inserting or removing the closure arrangement therefrom.

According to a preferred embodiment of the present invention, the lock ring comprises a solid piece comprising two or more ears adapted to attach lifting means. Preferably, the lifting means comprise commercially available eye bolts intended for lifting.

According to a preferred embodiment of the present invention, wherein the inwardly protruding shoulder of the collet is adapted to be inserted between a first piece and a second piece on the bearing assembly wherein the first piece is adjacent to the second piece and wherein the collet does not create a rotational lock to said bearing assembly.

According to a preferred embodiment of the present invention, upon installation, the bearing assembly is maintained in alignment with the body with anti-rotation pins.

According to a preferred embodiment of the present invention, the closure collet fingers further comprise a shallow inward facing taper adapted to engage with a shallow outward facing taper positioned on an upper outside circumferential edge of the body.

According to a preferred embodiment of the present invention, the closure collet is also adapted to expand over a lip located on the upper edge of the body.

Preferably, the closure collet and the body each comprise complimentary tapers adapted to mutually engage one another to guide and center the bearing assembly during the process of lowering the bearing assembly within the circular opening of the body.

Preferably, when the bearing assembly is fully seated in the body, the closure collet is secured to the body by fitting engagement of the upward facing tapered face on the bottom of the collet with the downward facing lower tapered face on the body.

According to a preferred embodiment of the present invention, the collet lock ring is adapted to freely move when located around the middle section of the closure collet and can slide downward to the bottom section of the closure collet until a downward facing taper on the inside of the lock ring is in engagement with an upward facing taper on the closure collet.

According to another aspect of the present invention, there is provided a method of securing a bearing assembly into a body during managed pressure drilling operations, said body having an upper circumferential opening defining a circular aperture, wherein said method comprises:

- providing a closure arrangement according to a preferred embodiment of the present invention;
- securing the collet to the bearing assembly;
- securing a lift sling to lifting hooks located on the collet ring;
- lifting the bearing assembly;
- aligning the bearing assembly over the circular aperture in the body;
- lowering the bearing assembly into the circular aperture in the body (2);
- aligning the anti-rotation pins with the corresponding openings in the bearing assembly;
- sliding the closure collet down to be secured around the bottom section of the collet by abutting a downward facing taper on the inside of the lock ring with an upward facing taper on the closure collet; and
- removing the lift sling from the hooks located on the collet ring.

Additional features and advantages of the invention will be set forth in the detailed description which follows, and in part will be readily apparent to the person skilled in the art from that description or recognized by practicing the invention as described herein, including the detailed description which follows, the claims, as well as the appended figures.

BRIEF DESCRIPTION OF THE FIGURES

The invention may be more completely understood in consideration of the following description of various embodiments of the invention in connection with the accompanying figures, in which.

DESCRIPTION OF A PREFERRED EMBODIMENT OF THE INVENTION

Figure 1:
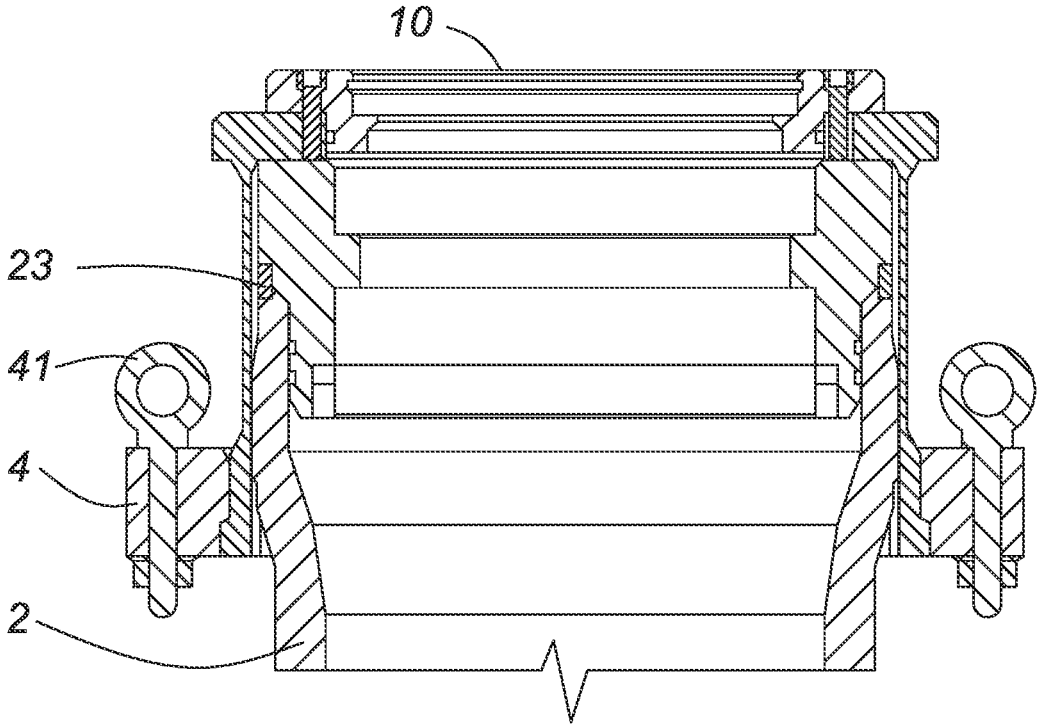
FIG. 1 is a side cross-sectional view of the clamping assembly according to a preferred embodiment of the present invention.
Figure 2:
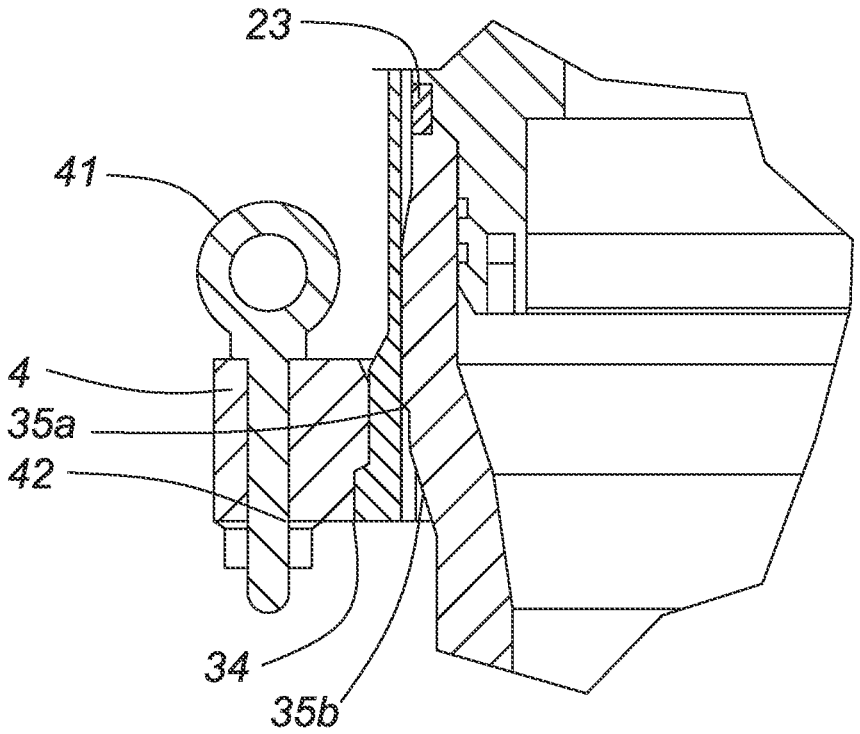
FIG. 2 is a close-up of a side cross-sectional view of the clamping assembly according to a preferred embodiment of the present invention.

The clamping mechanism is preferably a collet which is viewable in FIGS. 1 and 2. The main benefits of the closure arrangement according to the present invention are that: no one has to climb onto the BOP stack to install or remove the bearing; and it does not require the use of hydraulics. The former is a clear safety advantage over other known devices and the latter relieves the amount of equipment required for the installation of an RCD.

According to a preferred embodiment of the present invention, the closure arrangement consists of 4 separate pieces: bearing assembly, body, closure collet, and collet lock ring.

Figure 3:
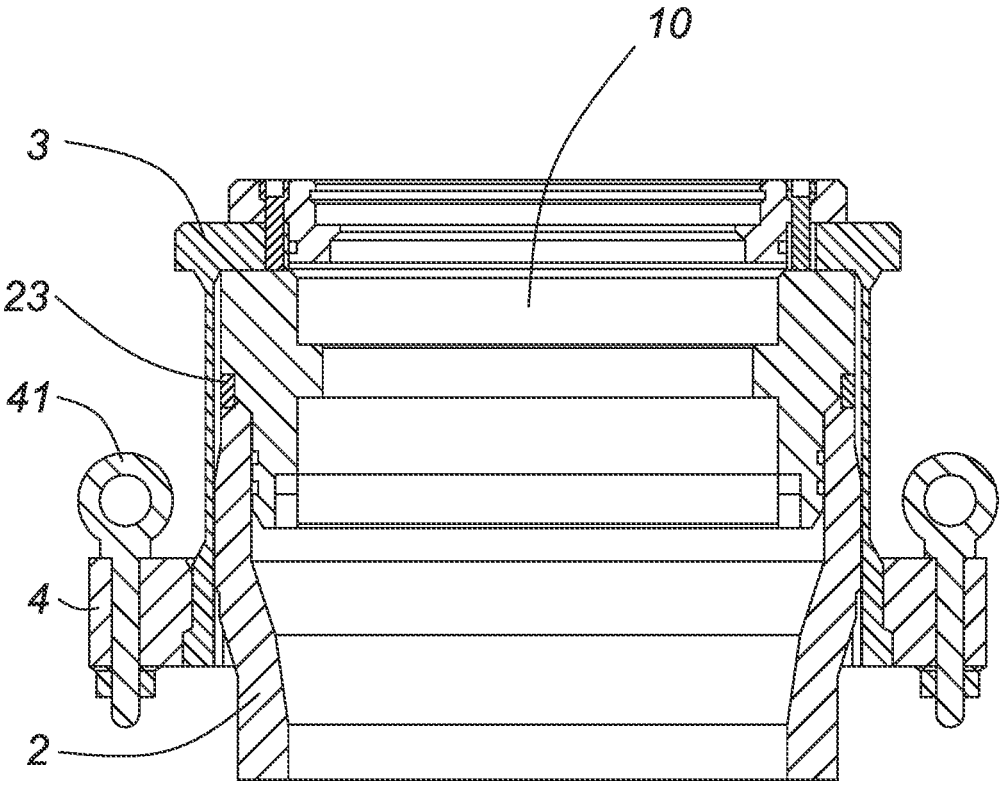
FIG. 3 is another side cross-sectional view of the clamping assembly according to a preferred embodiment of the present invention.

FIGS. 1, 2 and 3 depict the collet lock ring captured between two pieces on the bearing assembly with clearance and are not rotationally locked. The outside top of the body has two different tapered faces which oppose each other (tapered in opposite directions). The upward facing taper is shallower than the downward facing one so the installation force is lower compared to the removal force. Preferably, the closure collet is a single piece with a solid upper ring, and the lower part consists of multiple flexible fingers integral to the upper part which allow the expansion of the lower part over the body. The lock ring is a solid piece with two ears to attach commercially available eye bolts intended for lifting.

Once everything is assembled, the lock ring cannot be removed from the closure collet due to an upward facing taper at the bottom and a shoulder at the top. Once installed inside the body as desired, the bearing assembly is rotationally locked to the body through the use of dowel pins which are press fit into the top face of the body. These pins engage in slots in the bottom face of the bearing assembly.

Installation Sequence

To install the closure arrangement according to a preferred embodiment of the present invention and illustrated in accompanying FIGS. 1, 2, 3, 4, 5, 6 and 7.

1) A two leg sling (not shown) is attached to the lift eyes (41) which are attached to the collet lock ring (4). When lifting, the collet lock ring (4) moves up freely and sits on the shoulder face of the closure collet (3). The entire bearing assembly is suspended from the lock ring.
2) The bearing assembly (10) is lowered into the body (2) and is rotated to the correct alignment to fit the anti-rotation pins (23). During lowering, the shallow downward facing taper (35*a*) on the closure collet engages on a shallow upward facing taper (21) on the outside of the body (2) and expands over the lip (24) on the body (2). Tapers on all parts guide the assembly to center as it is lowered. Another taper (35*b*) is adapted to fit against the body (2) at a lower position than the first inside taper (35*a*) located at the bottom portion of the fingers (32).
3) When the bearing assembly (10) is fully seated in the body (2), the closure collet (3) will be in a position which allows it to return to its natural position. In this position, the upward facing tapered face (232) on the bottom of the collet (3) engages a downward facing lower tapered face (22) on the body.

4) Lowering of the bearing assembly (10) is continued and the lock ring (4) freely moves downward on the closure collet beyond the upward facing taper (36) until the downward facing taper (34) on the inside of the lock ring (4) engages with an upward facing taper (42) on the closure collet. The bearing assembly (10) is now held in place in the body (2) since the lock ring (4) prevents the closure collet (3) from expanding.
5) The closure arrangement secures the bearing assembly to the body and the lift sling is removed. The unit is now ready for operation.

The removal can be effected by following these steps:

1) A two leg sling is attached to the lift eyes which are attached to the collet lock ring.
2) The lock ring is lifted, which will allow the collet fingers to expand over the body. The entire bearing assembly is now free to be removed.
3) The lock ring is lifted until it engages on the upper shoulder of the closure collet.
4) Lifting is continued, the closure collet fingers expand over the body. At this point, the entire bearing assembly is suspended.
5) Lifting is continued until the bearing unit is clear of the body. At this point, any service can be performed and the unit reinstalled.

Figure 5:
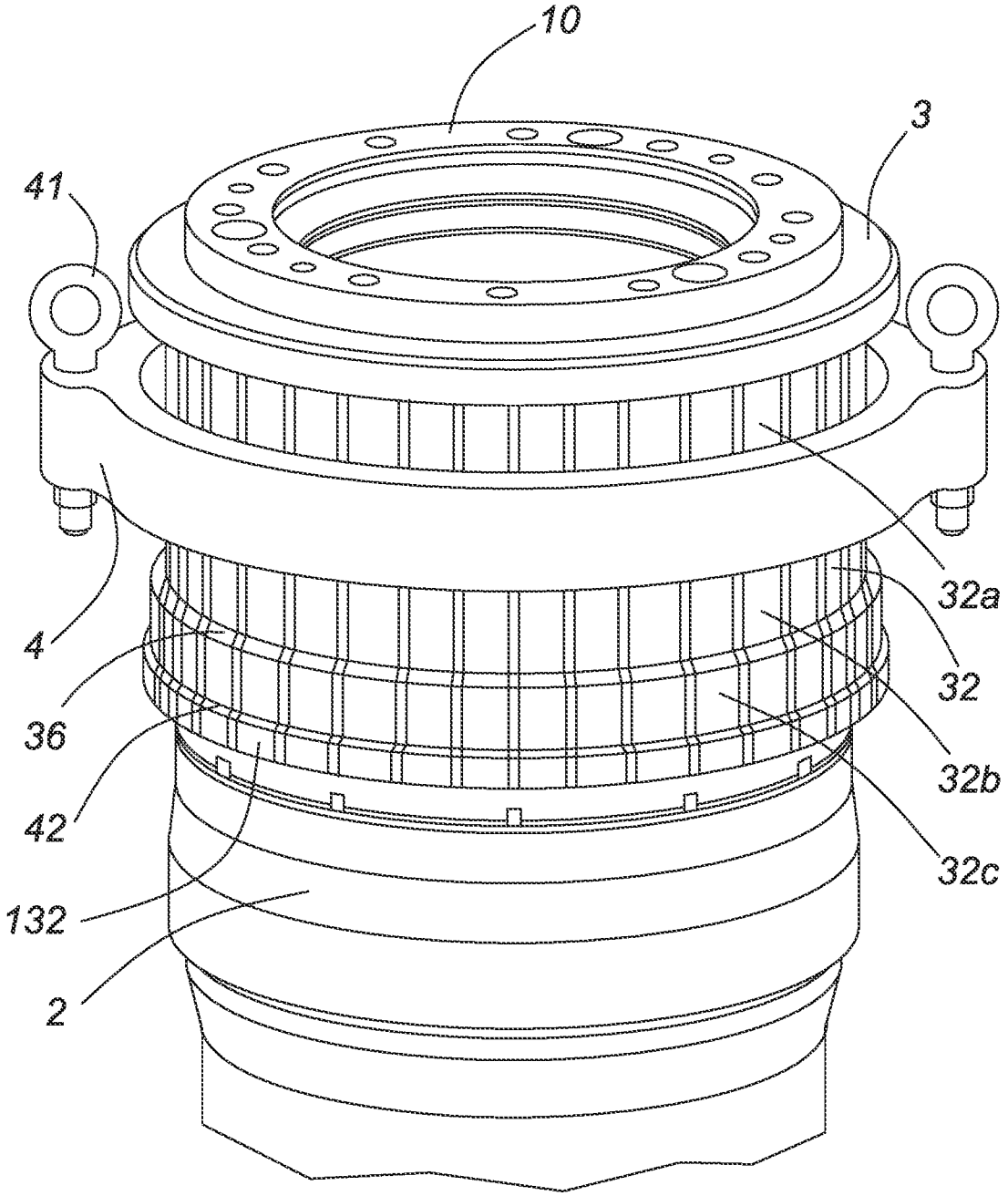
FIG. 5 is a perspective view of the clamping assembly according to a preferred embodiment of the present invention where the collet is positioned above the body.
Figure 6:
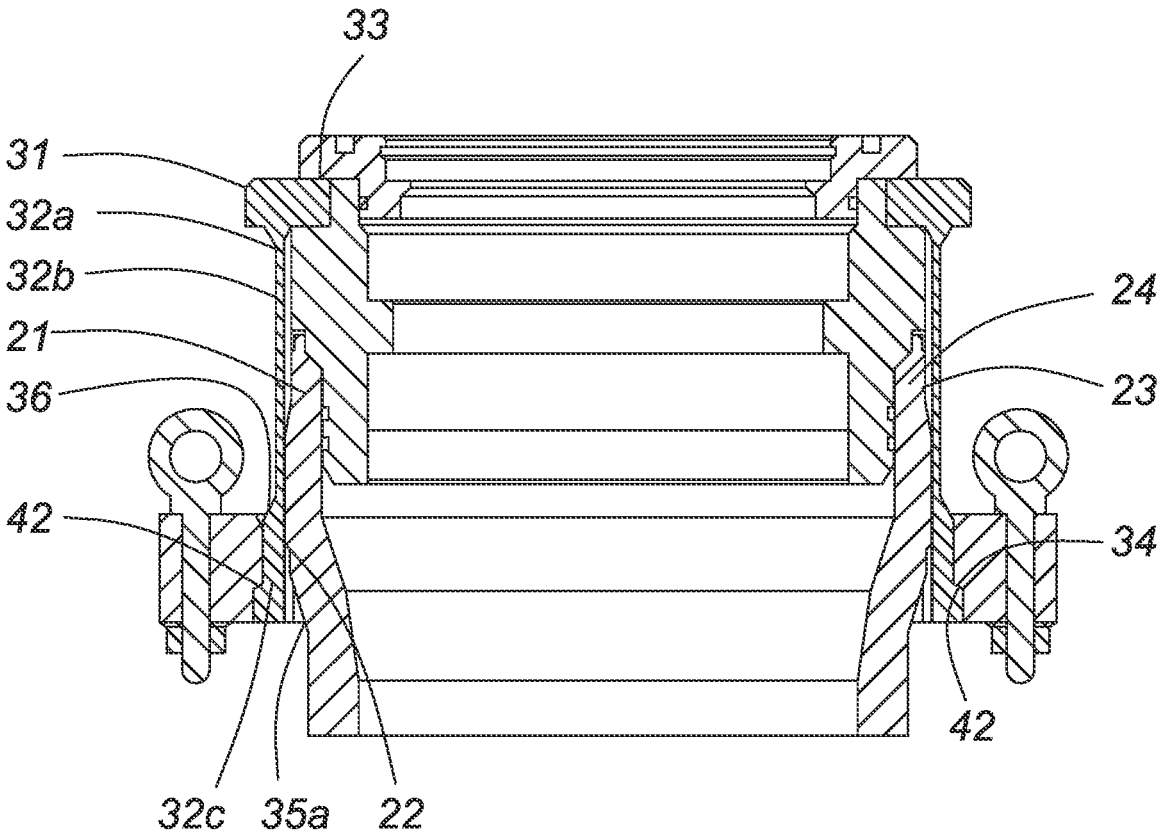
FIG. 6 is a side cross-sectional view of the clamping assembly according to a preferred embodiment of the present invention where the collet is positioned on the body and the collet ring is positioned around the bottom portion of the collet.
Figure 7:
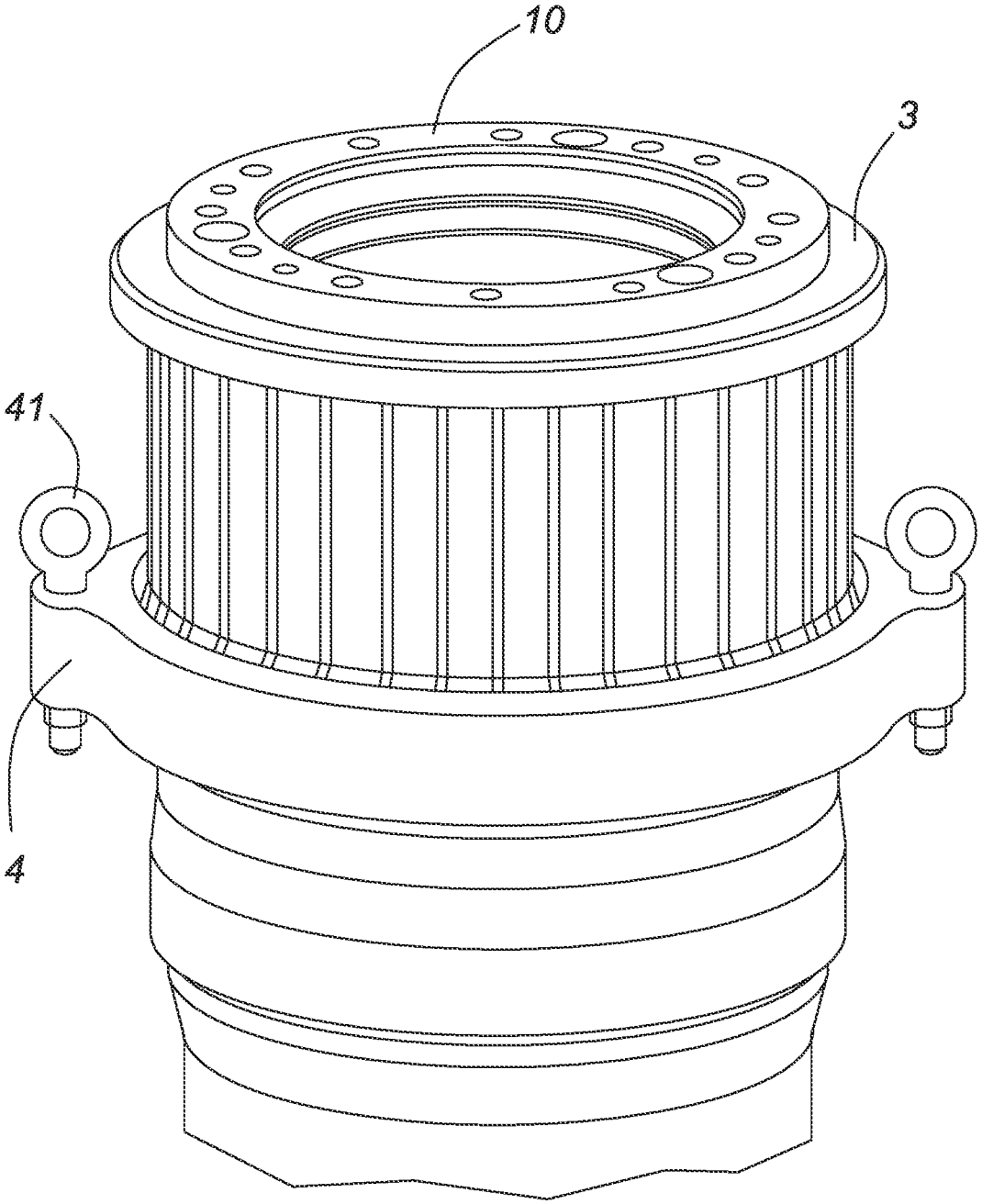
FIG. 7 is a perspective view of the clamping assembly according to a preferred embodiment of the present invention where the collet is positioned on the body and the collet ring is positioned around the bottom portion of the collet.

FIGS. 5, 6 and 7 illustrate the advantage of having a collet with a plurality downward extending finger (32). When lined up with the body, the fingers (32) can be pressed down around the circumference (21) of the top portion (24) of the body (2) and positioned prior to the sliding of the collet ring thereon. This facilitates the task of installation of the closure arrangement onto the body. Moreover, preferably the fingers are shaped to accommodate the collet ring in a middle portion (32*b*) of the collet (32) when the latter is not installed securely to the body. The bottom portion (32*c*) of the collet basically is the section comprising the extremity of the fingers which, when properly positioned on the body allow the collet ring to slide into position around the bottom portion (32*c*) of the collet and be thereafter tightened to secure the closure arrangement onto the body (2).

According to a preferred embodiment of the present invention, each one of the fingers (32) is identical and comprises a top portion (32*a*) coinciding with the top portion of the collet (3), a middle section (32*b*) which is narrower and adapted to receive the collet ring and allow such to slide up and down in the installation process and a bottom section adapted to provide a tight fit around the body. More specifically, the bottom portion of the fingers has an enlarged tip having protrusions both inwardly and outwardly. The inward protrusions are meant to fit into a space on the body located beneath the top portion, while the outward protrusions on the bottom section of the fingers are meant to prevent the collet ring from slipping off when the latter is lowered in position to secure the closure arrangement. The overall barbell-like shape of each one of the fingers allows to act as a whole as a means to maintain the closure collet around the collet at all times. Upon securing the collet to the body or removing the collet from the body, the collet ring basically is located around the middle section (32*b*) allowing the fingers (32) to expand, as their shape allows to go over the circumferential edge of the body and be either installed around the body or removed from the body depending on the operation being carried out.

Figure 4:
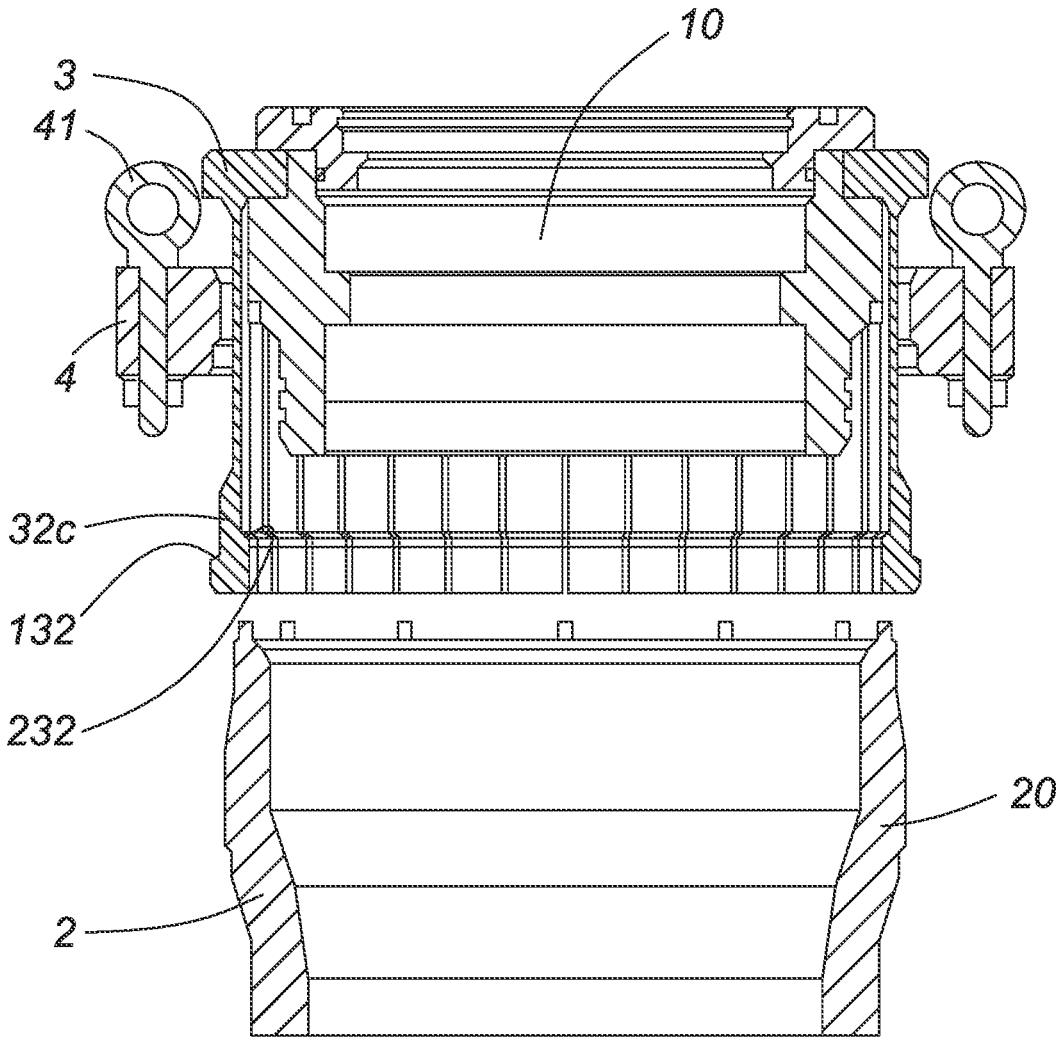
FIG. 4 is a side partially cross-sectional view of the clamping assembly according to a preferred embodiment of the present invention where the collet is positioned above the body.

Preferably also, the bottom portions (32*c*) of the fingers and the outer circumference of the body have a complementary taper and lip to provide a secure tight and impermeable fit. This is best illustrated in FIG. 4 where the bottom portion (32*c*) of the fingers (32) have a bottom outwardly extending lip (132) and an inwardly extending taper (232), the latter adapted to tightly fit into a spacing on the body (2) situated directly underneath the top portion (24). Preferably, the inwardly extending taper (232) will abut with the outwardly flaring section (22) situated immediately underneath the top portion (24) of the body. Preferably, the fingers are made of resilient material. Preferably, since fatigue resistance is important, the collet piece should not be made of aluminum alloys. Preferably, various carbon steel, alloy steel, stainless steel, or inconel alloys would all be suitable depending on the specific strength of each composition.

While the foregoing invention has been described in some detail for purposes of clarity and understanding, it will be appreciated by those skilled in the relevant arts, once they have been made familiar with this disclosure that various changes in form and detail can be made without departing from the true scope of the invention in the appended claims.

The invention claimed is:

1. A closure arrangement for use on a rotating control device used during managed pressure drilling, said closure arrangement comprising:

a bearing assembly;

a body wherein said bearing assembly is inserted into said body, said body defining an upper circular opening and comprising an outer circumferential edge and a downward facing lower tapered face, said body having anti-rotation pins incorporated therein;

a closure collet comprising a top section having an outwardly protruding shoulder, an inwardly protruding shoulder, and a plurality of spaced apart fingers extending downwardly forming a middle section and a bottom section of said closure collet; said closure collect further having an upward facing tapered surface on said bottom section that engages the downward facing lower tapered face of said body, said spaced apart fingers arranged to securely and removably fit around said outer circumferential edge of said body;

a collet lock ring secured around the bottom section of the closure collet;

wherein the inwardly protruding shoulder of the closure collet is inserted between a first piece and a second piece on the bearing assembly wherein the first piece is adjacent to the second piece;

wherein the bearing assembly is lowered into the body and is rotated to a correct alignment to fit anti-rotation pins;

wherein the spaced apart fingers further comprise: (a) a shallow inward facing taper engaged with a shallow outward facing taper positioned on an upper outside circumferential edge of the body; (b) a top portion coinciding with the top portion of the closure collet, a middle section that is narrower than the top portion and which receives the collet ring and allows the collet ring to slide up and down during installation, (c) a bottom section that provides a tight fit around the body; and (d) wherein the bottom of the fingers have an outwardly extending lip and an inwardly extending taper such that a lower edge of the bottom section of the fingers are substantially flush with the collet lock ring when installed; and wherein the collet lock ring further includes a solid piece having two or more ears and lifting means attached to said two or more ears.

2. The closure arrangement according to claim 1, wherein the inwardly protruding shoulder of the closure collet is fitted to a complementary cavity located on said bearing assembly.

3. The closure arrangement according to claim 1, wherein the closure collet comprises a single piece comprising an upper section itself comprising a solid upper ring, the lower section comprising the plurality of flexible fingers is integral with the upper section and arranged to allow the expansion of the lower part over the outer circumferential edge of the body when inserting or removing the closure arrangement therefrom.

4. The closure arrangement according to claim 1, wherein upon installation of the bearing assembly is maintained in alignment with the body with anti-rotation pins.

5. The closure arrangement according to claim 1, wherein the closure collet expands over a lip located on the upper edge of the body.

6. The closure arrangement according to claim 1, wherein the closure collet and the body each comprise complimentary tapers that mutually engage one another to guide and center the bearing assembly during the process of lowering the bearing assembly within the circular opening of the body.

7. A method of securing a bearing assembly into a body during managed pressure drilling operations, wherein said method comprises:

providing a closure arrangement according to claim 1;

securing the collet to the bearing assembly;

securing a lift sling to lifting hooks located on the collet ring;

lifting the bearing assembly by a lifting means;

aligning the bearing assembly over the circular aperture in the body;

lowering the bearing assembly into the circular aperture in the body;

aligning the anti-rotation pins with the corresponding openings in the bearing assembly;

sliding the closure collet down to be secured around the bottom section of the collet by abutting a downward facing taper on the inside of the lock ring with an upward facing taper on the closure collet; and removing the lift sling from the hooks located on the collet ring.

* * * * *